US007564299B2

(12) United States Patent
Shor et al.

(10) Patent No.: US 7,564,299 B2
(45) Date of Patent: Jul. 21, 2009

(54) VOLTAGE REGULATOR

(75) Inventors: Joseph Shor, Tel Mond (IL); Eyal Fayneh, Givatayim (IL)

(73) Assignee: Intel Corporation, Santa Clara, CA (US)

( * ) Notice: Subject to any disclaimer, the term of this patent is extended or adjusted under 35 U.S.C. 154(b) by 196 days.

(21) Appl. No.: 11/210,050

(22) Filed: Aug. 22, 2005

(65) Prior Publication Data

US 2007/0040603 A1 Feb. 22, 2007

(51) Int. Cl.
*G05F 1/10* (2006.01)
*G05F 3/02* (2006.01)

(52) U.S. Cl. ..... 327/540; 327/541; 327/538

(58) Field of Classification Search ..... 327/538, 327/89, 252, 253, 560–563
See application file for complete search history.

(56) References Cited

U.S. PATENT DOCUMENTS 6,448,750 B1 * 9/2002 Shor et al. ..... 323/282
6,791,396 B2 9/2004 Shor et al.
6,864,739 B2 3/2005 Shor et al.
6,885,244 B2 4/2005 Shor
2002/0153943 A1 * 10/2002 Uchiki et al. ..... 327/563
2003/0078803 A1 * 4/2003 Xie ..... 705/1
2006/0170461 A1 * 8/2006 Bhattacharya et al. ..... 327/65
2007/0139110 A1 * 6/2007 Prouet et al. ..... 330/252

OTHER PUBLICATIONS

Marc G. Degrauwe et al., *Adaptive Biasing CMOS Amplifiers*, IEEE Journal of Solid-State Circuits, vol. SC-17, No. 3, Jun. 1982.

Ludwig G.A. Callewaert et al., *Class AB CMOS Amplifiers with High Efficiency*, IEEE Journal of Solid-State Circuits, vol. 25, No. 3, Jun. 1990.

R. Klinke et al., *A Very-High-Slew-Rate CMOS Operational Amplifier*, IEEE Journal of Solid-State Circuits, vol. 24, No. 3, Jun. 1989.

* cited by examiner

*Primary Examiner*—Kenneth B Wells
*Assistant Examiner*—Daniel Rojas
(74) *Attorney, Agent, or Firm*—Erik R. Nordstrom

(57) ABSTRACT

In some embodiments, regulator circuits are provided.

2 Claims, 3 Drawing Sheets

VOLTAGE REGULATOR

BACKGROUND

Embodiments disclosed herein relate generally to voltage regulators and in particular to on-chip voltage regulators. Successive generations of processors are increasing the demands on loads such as phase locked loop (PLL) blocks, which require a regulated supply. Accordingly, improved regulator circuits are desired.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

Regulator embodiments are disclosed that can provide high power supply rejection ratio (PSRR) over wide frequency bands in a stable configuration. In fact, in some embodiments, output voltages within 200 mV of a supply rail may be attained.

Figure 1:
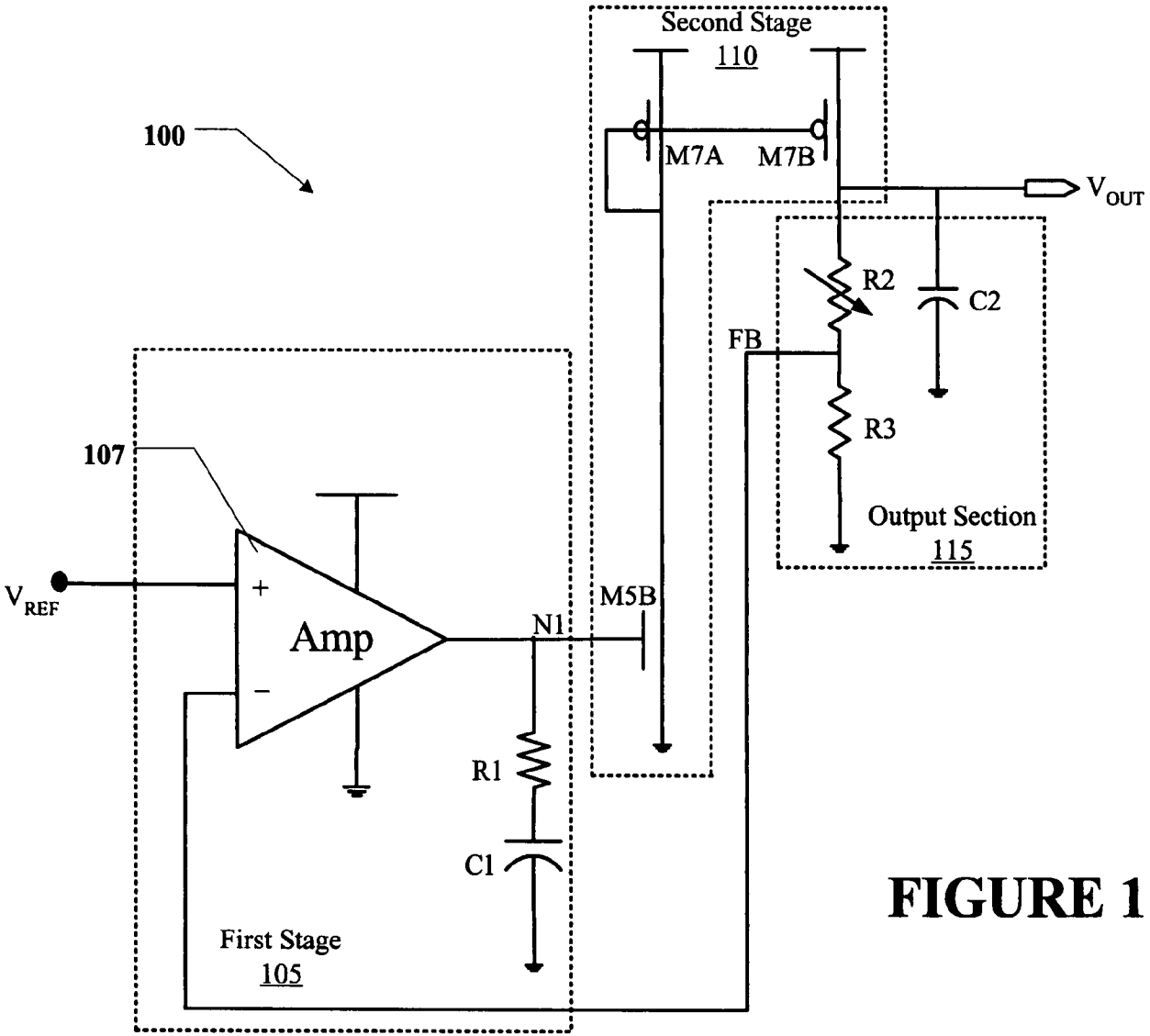
FIG. 1 is a schematic diagram of a regulator circuit according to some embodiments.

FIG. 1 shows a schematic diagram of a regulator 100 according to some embodiments of the invention. Regulator 100 is a two gm-stage regulator formed from a first amplifier stage 105, a second amplifier stage 110, and an output section 115. The first stage 105 is coupled to the second stage at the output (N1) of the first stage 105. The output section 115 is coupled to the second stage's output ($V_{OUT}$), which serves as the output of the regulator.

The output ($V_{OUT}$) is an analog supply voltage that may be used for any suitable application such as for supplying a regulated voltage to a phase locked loop (PLL). A reference voltage ($V_{REF}$) is coupled to an input of the first sage and determines the value of the regulated voltage that is provided at $V_{OUT}$. The reference voltage may be provided, for example, by an on-chip circuit that produces a stable, filtered reference voltage (e.g., 0.8 V). The output section 115 comprises voltage divider resistors R2/R3 for setting the output voltage ($V_{OUT}$) based on their values relative to one another and on the value of $V_{REF}$. For example, a 1:2 ratio of R2 to R3 with a 0.8 V referenced would result in an output ($V_{OUT}$) of 1.2 V. The output section 115 also includes a relatively large capacitor C2 (e.g., 300 pF) for filtering noise at the output.

The first stage 105 includes an amplifier 107, which may comprise any suitable amplifier circuit; it comprises a differential amplifier in the depicted figure. The differential amplifier has two voltages at its input, and converts them to two currents at the output. It also includes a resistor R1 (e.g., 1K Ohm) and capacitor C1 (e.g., 2 pF) coupled in series between node N1 and ground for compensation purposes. A first primary pole, resulting from amplifier 107, is associated with N1, while a second primary pole results from the output section and a coupled load (not shown). Thus, resistor R1 and capacitor C1 may be used to insert a zero into the regulator system to separate these first and second poles. This allows the bandwidth of the first stage to be raised while maintaining system stability, which serves to improve the regulator's PSRR.

The second amplifier stage 110 comprises transistors M5B, M7A, and M7B coupled together in a common current path. (It should be noted that a "current path" may include, without limitation, elements whose currents are coupled directly together or indirectly together such as with current mirrors, folding elements, and non-conducting coupler devices to mention just a few.) Transistor M5B serves primarily as the gm driver, transistor M7B serves as an output transistor, and transistor M7A serves to mirror current from M5B to the output through output transistor M7B. In the depicted embodiment, M7B is scaled to M7A by a ratio of 4:1, which causes it to drive four times the current mirrored by M7A and thus M5B, as well. This ratio is a function of the design parameters, and in no way is considered a limitation of this invention. It should be noted that a current mirror serves to replicate a current, or a scaled version of the current from one branch of the circuit to another.

The output transistor, M7B, may be required to drive large currents with a relatively small $V_{DS}$ (e.g., less than 200 mV). for additional reasons (e.g., low parasitic capacitances to reduce high frequency supply noise), it is desirable to have a reasonably short channel length in M7B. On the other hand, PSRR is improved with a higher channel length because $R_{OUT}$ for the second stage (which is proportional to PSRR) increases with channel length. Thus, a channel length tradeoff is made in consideration of these two conflicting parameters. (In some embodiments, the sizing of M7B is 4000 um/0.2 um.) Unfortunately, even with a favorable tradeoff, PSRR resulting from the second stage (M7B in particular) may be insufficient. Accordingly, in some embodiments (as discussed below), the first stage amplifier 105 may be configured to enhance regulator PSRR (e.g., with increased bandwidth) while maintaining required system performance and stability.

Figure 2:
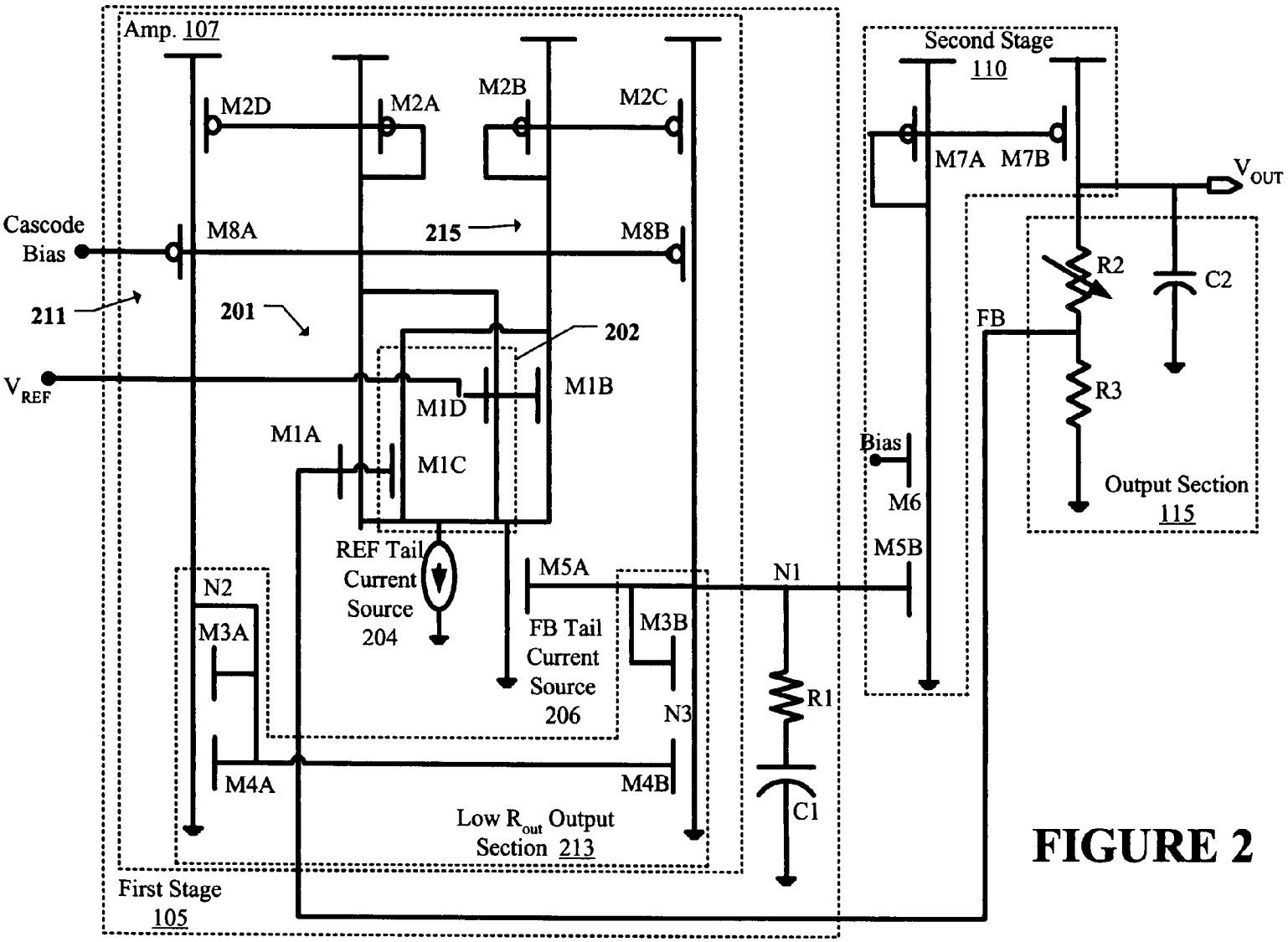
FIG. 2 is a more detailed schematic diagram of the regulator circuit of FIG. 1 according to some embodiments.

FIG. 2 shows a more detailed schematic of the first amplifier stage 105 within regulator 100 according to some embodiments. In this figure, the second amplifier stage 110 is essentially the same except that it has an added cascode transistor M6 coupled between M5B and M7A and thus, it will not be further discussed.

In order to provide good PSRR without degrading stability performance, amplifier 105 is designed to have a relatively low gain (e.g., 20 to 30 dB) with a relatively high bandwidth. As will be discussed in greater detail herein, one of the ways this is accomplished is by providing it with a low ROUT at node N1, which decreases its DC gain.

The first stage 105 generally comprises a differential amplifier section 201, a mirror driver section 211, a low-$R_{OUT}$, pull-down output section 213, and a pull-up output section 215. The differential amplifier section 201 has first and second inputs: reference voltage (VREF) and a feedback voltage (FB) fed back from the regulator output section 115. It is coupled to the pull-up section 215 and mirror driver section 211, which in turn is coupled to the low $R_{OUT}$, pull-down output section 213 to drive it based on the differential amplifier 201. In operation, the differential amplifier 201 causes the pull-up output section 215 to pull up the voltage at N1 when the feedback voltage (FB) is less than the reference voltage ($V_{REF}$). Conversely, it causes the mirror driver section 211 to drive the low $R_{OUT}$, pull-down section 213 to pull down the output voltage at N1 when the voltage at FB is greater than $V_{REF}$. In this way, it controls the voltage at N1 to appropriately drive the second stage amplifier 110 through M5B in order to cause the regulator output ($V_{OUT}$) to suitably track $V_{REF}$.

In the depicted embodiment, the first stage 105 has several features that allow it to enhance regulator PSRR. To begin with, it has a relatively low output resistance ($R_{OUT}$), by way of the pull-down output section 213, which lowers the first stage's DC gain and thus allows it to have an increased bandwidth while not violating regulator stability requirements. In addition, the differential amplifier section 201 has a dynamic current source for increasing its strength when the current load at $V_{OUT}$ is higher and decreasing it when the current load is lower. This takes advantage of the fact that the second primary pole (at $V_{OUT}$) goes to higher frequency as the current load increases and goes to lower frequency as the current load decreases. Thus, more amplification at the first amplifier stage 105 can be tolerated while maintaining system stability as the output load current increases. Finally, the differential input section 201 also may include a gm reducing section 204, which allows the differential amplifier to drive sufficient current at a reduced DC gain thereby allowing it to have an even higher bandwidth. (As used herein, the term "gm reducing section" refers to any circuit to lower the gm in an amplifier without significantly reducing its current capability.) It should be noted that not all of these features are necessarily present in all embodiments of the invention. Different embodiments may have different combinations, depending on a given design and design requirements.

In the depicted embodiment, the differential amplifier section 201 comprises transistors M1A and M1B, each of which provides current to a branch of the differential amplifier, a gm reducing section 204 (formed from transistors M1C and M1D), reference tail-current source 204, and feedback tail-current source 206 coupled to one another as indicated. (A tail current source is any transistor or circuit which supplies current to a differential stage). Transistors M1A and M1B, in cooperation with the reference tail-current source 204, which is biased at a fixed level (e.g., 30 micro amps), operate as a conventional differential amplifier. Transistor M5A, which is scaled to M5B, functions as a dynamic tail-current source for the differential amplifier to dynamically provide it with source current in proportion to the current demand at $V_{OUT}$. Its current mirrors the current in M5B, which is in a common current path with the output driving transistor M7B. Thus, since the current in M5A is effectively mirrored by M5B, its current corresponds to the regulator output current, which is in the same output current path as M5B. In some embodiments, the feedback tail-current source M5A provides current ranging between 0 and 500 micro amps to the differential amplifier 201.

The gm reducing circuit 202 comprises transistors MIC and MID cross-coupled to transistors MIA and MIB to lower the effective differential amplifier gm without choking M5A. Relatively large current is desired for the current sources (especially the dynamic source 206) because it implies a low output resistance and thus low DC gain, allowing higher bandwidth for the differential amplifier section 201. Thus, sufficient drain/source voltage is needed for M5A to operate in saturation. However, not a lot of voltage may necessarily be available. (Note that $V_{REF}$, may, for example, be at 0.8V.) Therefore, it is desirable for M1A and M1B to be designed to have reasonably small $V_{DSAT}$ values. However, without relatively large gm values, M1A and M1B could not provide large current with low $V_{DSAT}$ values. But a large gm is not desired because it results in a higher DC gain and thus less bandwidth capability. Accordingly, the gm reducing circuit (M1C and M1D), with its cross-coupled configuration, operates to divert current from one branch to the other to provide (or sink) sufficient overall current at the current sources without requiring a large differential amplifier gm. (In some embodiments, transistors M1A and M1B are three times larger than M1C and M1D.)

The low $R_{OUT}$ pull-down output section 213 is configured to provide an appropriate voltage range at the gate of M5B (node N1) based on current driven through it by the mirror driver section 211. It comprises scaled transistors M3A/M3B, each being diode connected, and scaled transistors M4A/M4B, coupled as shown between M3A/M3B and ground. M3A, M3B, M4A, and M4B are sized such that at the voltages needed to drive M5B, M4B will substantially be in a linear region. This occurs with M3A and M3B being in saturation (which results since they are diode connected) controllably forcing M4A and M4B to operate in linear regions. M3B and M3A are considered diode connected, since their gates are connected to their drains.

The linear region of transistor operation is a mode of operation where the transistor has a low Rout, or output resistance/impedance, as is well known by those skilled in the art. This is distinguished from the saturation mode, where the transistor generally has a high $R_{OUT}$. (An exception to this, as is well known in the art, is when a transistor is diode connected resulting in it having a relatively low $R_{OUT}$.) The linear region is defined by $Vds<V_{GS}-V_T$, where $V_{GS}$ is the gate-source voltage, $V_{DS}$ is the drain-source voltage and $V_T$ is the threshold voltage. Transistor M4B is forced in the linear region, since the feedback loop will bias N1 at a voltage slightly above $V_T$, so that M5B will have enough voltage at it's gate to drive the required current to the output. The $V_{GS}$ of M3B is at least $V_T$, since it is diode connected. This leaves a small $V_{DS}$ for M4B. Thus M4B, M3B and M5B in this configuration can be sized to guarantee-by-design that M4B is in the linear region.

With M4B operating in a linear region, it is able to provide a suitable voltage range at N1, while having a relatively low resistance. with M3B being diode connected (and thus having a low resistance as well), the series combination of M3B and M4B also has a relatively low resistance. This results in a low DC output resistance ($R_{OUT}$) for the first amplifier stage 105. This low Rout results in a low first amplifier stage DC gain thereby allowing for a higher bandwidth driving N1, which enhances regulator PSRR. (With such a low DC gain, the imbalance in the voltages at N1 and N2 will typically cause a systematic offset at the output. Fortunately, this can be corrected by the feedback tail current source 206 (M5A). At high output currents, the current in the entire circuit is raised, and the voltage at N2 increases to match the increase of N1. Under these conditions, the second primary (output) pole is at a higher frequency, so it is possible to increase the gain and bandwidth of the first stage without adversely affecting stability. This dynamic biasing also helps to keep M4B in the linear region for higher N1 voltages.)

(It should be appreciated that while the low $R_{OUT}$ output section is disposed in the pull-down portion of the first-stage, it alternatively could be placed in any suitable part of the first amplifier stage. For example, it could instead be placed in the pull-up section, which also would provide a low output resistance for the first amplifier stage 105.)

The mirror driver section 211 generally comprises scaled, current mirror connected transistors M2A/M2D and a conventional cascode transistor M8A. As indicated, the mirror driver section is in a common current path with the $V_{REF}$ branch of differential amplifier 201 and the low $R_{OUT}$ pull-down output section 213 to drive the pull-down section in response to voltage changes between $V_{REF}$ and FB at the differential amplifier section 201.

Likewise, the pull-up output section 215 generally comprises scaled, mirror connected transistors M2B/M2C and a conventional cascode transistor M8B. The pull-up output section 215 is in a common current path with the FB branch of the differential amplifier 201, which supplies it with current in response to the voltage difference between $V_{REF}$ and FB. It turns on with greater current, relative to M4B, to pull up the voltage at N1 when the voltage at FB is less than $V_{REF}$. Conversely, it turns on with less current, relative to M4B, resulting in the voltage at N1 decreasing when the voltage at FB is greater than $V_{REF}$.

Figure 3:
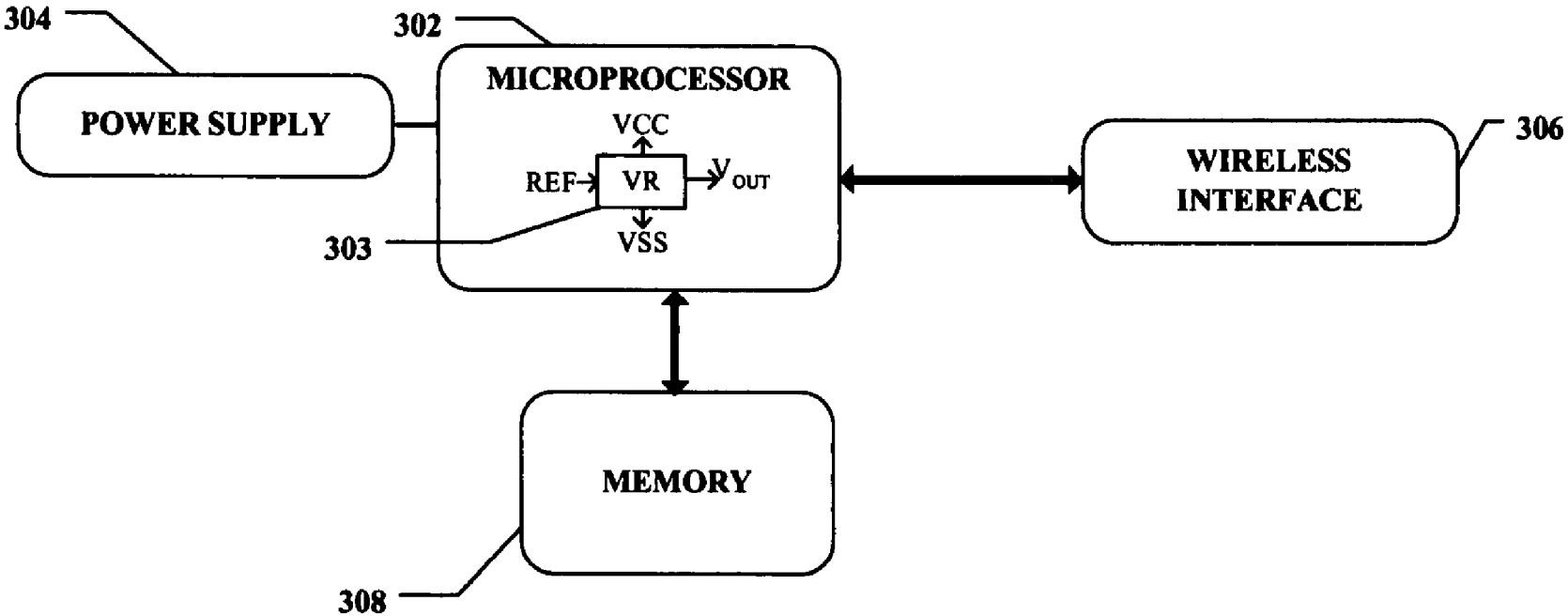
FIG. 3 is a block diagram of a system having a processor chip with a regulator circuit in accordance with some embodiments of the invention.

With reference to FIG. 3, one example of a computer system is shown. The depicted system generally comprises a processor 302 that is coupled to a power supply 304, a wireless interface 306, and memory 308. It is coupled to the power supply 304 to receive from it power when in operation. It is coupled to the wireless interface 306 and to the memory 308 with separate point-to-point links to communicate with the respective components. It comprises one or more voltage regulators 303 according to some embodiments of the invention. For example, in some embodiments, it is coupled to a phase locked loop circuit to provide it with a suitable regulated voltage supply.

It should be noted that the depicted system could be implemented in different forms. That is, it could be implemented in a single chip module, a circuit board, or a chassis having multiple circuit boards. Similarly, it could constitute one or more complete computers or alternatively, it could constitute a component useful within a computing system.

The invention is not limited to the embodiments described, but can be practiced with modification and alteration within the spirit and scope of the appended claims. For example, it should be appreciated that the present invention is applicable for use with all types of semiconductor integrated circuit ("IC") chips. Examples of these IC chips include but are not limited to processors, controllers, chip set components, programmable logic arrays (PLA), memory chips, network chips, and the like.

Moreover, it should be appreciated that example sizes/models/values/ranges may have been given, although the present invention is not limited to the same. As manufacturing techniques (e.g., photolithography) mature over time, it is expected that devices of smaller size could be manufactured. In addition, well known power/ground connections to IC chips and other components may or may not be shown within the FIGS. for simplicity of illustration and discussion, and so as not to obscure the invention. Along these lines, while ground references are primarily shown. Any suitable supply reference (e.g., negative or positive voltages could alternatively be used if appropriate.) Furthermore, arrangements may be shown in block diagram form in order to avoid obscuring the invention, and also in view of the fact that specifics with respect to implementation of such block diagram arrangements are highly dependent upon the platform within which the present invention is to be implemented, i.e., such specifics should be well within purview of one skilled in the art. Where specific details (e.g., circuits) are set forth in order to describe example embodiments of the invention, it should be apparent to one skilled in the art that the invention can be practiced without, or with variation of, these specific details. The description is thus to be regarded as illustrative instead of limiting.

What is claimed is:

1. A regulator circuit, comprising:

a first amplifier stage having: (i) an input coupled to a reference, (ii) an output, (iii) a differential amplifier with a gm reducing circuit, and (iv) an output section with at least one transistor biased to lower the output resistance of the first amplifier stage, wherein the gm reducing circuit is implemented by feeding current from a first branch of the differential amplifier to the output of a second branch of the differential amplifier and feeding current from the second branch to the output of the first branch; and a second amplifier stage having an output and an input coupled to the output of the first amplifier stage, wherein the differential amplifier comprises a tail current source to vary its strength in accordance with load changes at the output of the second amplifier stage, the tail current source comprising a transistor mirrored to a transistor in the output current path.

2. The regulator circuit of claim 1, in which the differential amplifier comprises a second tail current source with a fixed reference bias.

* * * * *